US005988280A

United States Patent [19]

Crawford et al.

[11] Patent Number: 5,988,280

[45] Date of Patent: Nov. 23, 1999

[54] USE OF ENGINE HEAT IN TREATING A WELL BORE

[75] Inventors: James B. Crawford, Lafayette; Michael J. LeBlanc, Broussard, both of La.

[73] Assignee: AMBAR, Inc., Houston, Tex.

[21] Appl. No.: 08/772,314

[22] Filed: Dec. 23, 1996

[51] Int. Cl.[6] ..... E21B 36/00

[52] U.S. Cl. ..... 166/303; 166/57; 405/128

[58] Field of Search ..... 166/302, 303, 166/57, 77.2, 90.1, 272.2; 405/128

[56] References Cited

U.S. PATENT DOCUMENTS

| | | | |
|---|---|---|---|
| 2,823,752 | 2/1958 | Walter | 166/57 X |
| 3,066,737 | 12/1962 | Baldwin | 166/57 |
| 3,156,299 | 11/1964 | Trantham | 166/272.1 X |
| 3,522,843 | 8/1970 | New | 166/303 X |
| 3,658,270 | 4/1972 | Slator et al. | 166/77.2 X |
| 3,833,059 | 9/1974 | Sisson | 166/303 X |
| 4,044,549 | 8/1977 | Zwick | 60/39.02 |
| 4,197,712 | 4/1980 | Zwick et al. | 62/53 |
| 4,255,116 | 3/1981 | Zwick | 431/11 |
| 4,290,271 | 9/1981 | Granger | 62/53 |
| 4,373,896 | 2/1983 | Zwick et al. | 431/9 |
| 4,454,917 | 6/1984 | Poston | 166/303 |
| 4,472,946 | 9/1984 | Zwick | 62/55 |
| 4,480,695 | 11/1984 | Anderson | 166/303 |
| 4,546,610 | 10/1985 | Zwick | 62/52 |
| 4,589,488 | 5/1986 | Schirmer | 166/303 X |
| 4,655,285 | 4/1987 | Spitzer | 166/250 |
| 4,860,545 | 8/1989 | Zwick et al. | 62/50.6 |
| 4,882,009 | 11/1989 | Santoleri et al. | 166/267 X |
| 4,924,679 | 5/1990 | Brigham et al. | 62/50.7 |
| 5,056,315 | 10/1991 | Jenkins | 60/614 |
| 5,215,454 | 6/1993 | Ferramola et al. | 431/2 |
| 5,242,133 | 9/1993 | Zwick | 244/134 C |
| 5,261,765 | 11/1993 | Nelson | 405/128 |
| 5,282,590 | 2/1994 | Zwick | 244/134 C |
| 5,335,728 | 8/1994 | Strahan | 166/57 X |
| 5,388,650 | 2/1995 | Michael | 175/71 |
| 5,656,136 | 8/1997 | Gayaut et al. | 166/302 |

OTHER PUBLICATIONS

Walker, et al. "Heated Acid for Improved Stimulation Results," SPE# 13371, Oct. 31, 1984, pp. 159–163.

*Primary Examiner*—Roger J. Schoeppel
*Attorney, Agent, or Firm*—Arnold White & Durkee

[57] ABSTRACT

A method of heating a chemical solution used in a well bore having a tubing string is disclosed. The well bore will intersect a hydrocarbon reservoir. The method will comprise providing a diesel engine that produces heat as a result of its operation. The engine will in turn produce a gas exhaust, a water exhaust, and a hydraulic oil exhaust. The method would further include channeling the exhaust to a series of heat exchangers. The method may further include flowing a treating compound into the heat exchangers and heating the treating compound in the series of heat exchangers by heat transfer from the exhaust to the treating compound. The operator may then inject the treating compound into the well bore for treatment in accordance with the teachings of the present invention. One such method would be to inject utilizing a coiled tubing unit. The novel thermal fluid heating system is also disclosed.

27 Claims, 3 Drawing Sheets

USE OF ENGINE HEAT IN TREATING A WELL BORE

BACKGROUND OF THE INVENTION

This invention relates to an apparatus and method for treating a well bore. More particularly, but not by way of limitation, this invention relates to an apparatus and method for heating a treating compound, and thereafter, placing the treating compound within a well bore.

In the exploration and development of hydrocarbon reservoirs, a well is drilled to a subterranean reservoir, and thereafter, a tubing string is placed within said well for the production of hydrocarbon fluids and gas, as is well understood by those of ordinary skill in the art. As the search for additional reserves continues, offshore and remote areas are being explored, drilled and produced with increased frequency. During the production phase, the production tubing may have deposited within the internal diameter such compounds as paraffin, asphaltines, and general scale which are precipitated from the formation fluids and gas during the temperature and pressure drops associated with production.

Further, the subterranean reservoir may become plugged and/or damaged by drilling fluids, migrating clay particles, etc. Once the reservoir becomes damaged, the operator will find it necessary to stimulate the reservoir. One popular method of treatment is to acidize the reservoir.

Both the treatment of tubing string and the reservoir may be accomplished by the injection of specific compounds. The effect of the treating compounds will many times be enhanced by heating the treating compound. Thus, for the treatment of paraffin and asphaltines, the heating of a specific treating compound (e.g. diesel) enhances the removal. Also, in the acidizing of a reservoir, the heating of a specific treating compound (e.g.hydrochloric acid) enhances the treatment efficency.

In order to heat these types of compounds, operators utilize an open or enclosed flame. However, government regulations have either banned or limited the use of open or enclosed flames on offshore locations and some land locations. Thus, there is a need for a thermal fluid unit that will heat a chemical compound without the need for having an open flame. There is also a need for a method of treating well bores with a heated treating compound.

SUMMARY OF THE INVENTION

A method of heating a chemical solution used in a well bore having a tubing string is disclosed. The well bore will intersect a hydrocarbon reservoir. The method will comprise providing a diesel engine that produces heat as a result of its operation. The engine will in turn produce a gas exhaust, a water exhaust, and a hydraulic oil exhaust.

The method would further include channeling the gas exhaust to a gas exhaust heat exchanger, and channeling the water exhaust to a water exhaust heat exchanger. The method further includes injecting a compound into the water exhaust heat exchanger, and heating the compound in the water exhaust heat exchanger. The method may also include producing a hydraulic oil exhaust from the diesel engine and channeling the hydraulic oil exhaust to a hydraulic oil heat exchanger. Next, the compound is directed into the hydraulic oil heat exchanger, and the compound is heated in the hydraulic oil heat exchanger.

The method may further comprise flowing the compound into the gas exhaust heat exchanger and heating the compound in the gas exhaust heat exchanger. The operator may then inject the compound into the well bore for treatment in accordance with the teachings of the present invention.

In one embodiment, the compound comprises a well bore treating chemical compound selected from the group consisting of hydrochloric acid and hydrofluoric acid. The method further comprises injecting the chemical compound into the well bore and treating the hydrocarbon reservoir with the chemical compound.

In another embodiment, the compound comprises a tubing treating chemical compound selected from the group consisting of processed hydrocarbons such as diesel oil which is composed chiefly of unbranched paraffins, and the method further comprises injecting the processed hydrocarbon into the tubing string and treating the tubing string with the processed hydrocarbon.

In another embodiment, during the step of injecting the compound into the well bore, the invention provides for utilizing a coiled tubing unit having a reeled tubing string. The coiled tubing unit and the engine are opertively associated so that said engine also drives the coiled tubing unit so that a single power source drives the thermal fluid sytem and the coiled tubing unit. Thereafter, the reeled coiled tubing is lowered into the tubing string and the heated compound is injected at a specified depth within the tubing and/or well bore.

Also disclosed herein is an apparatus for heating a chemical solution used in a oil and gas well bore. The apparatus comprises a diesel engine that produces a heat source while in operation. The engine has a gas exhaust line, and a water exhaust line. The apparatus further includes a water heat exchanger means, operatively associated with the water exhaust line, for exchanging the heat of the water with a set of water heat exchange coils; and, a gas heat exchanger means, operatively associated with the gas exhaust line, for exchanging the heat of the gas with a set of water heat exchange coils.

Also included will be a chemical supply reservoir, with the chemical supply reservoir comprising a first chemical feed line means for supplying the chemical to the water heat exchanger means, and a second chemical feed line means for supplying the chemical to the gas heat exchanger means so that heat is transferred to the chemical.

The engine will also include a hydraulic oil line, and the apparatus further comprises a hydraulic oil heat exchanger means, operatively associated with the hydraulic oil line, for exchanging the heat of the hydraulic oil with a set of hydraulic oil heat exchange coils. The chemical supply reservoir further comprises a third chemical feed line means for supplying the chemical to the hydraulic oil heat exchanger means so that the chemical is transferred the heat.

In one embodiment, the gas exhaust line has operatively associated therewith a catalytic converter member and the gas heat exchanger means has a gas output line containing a muffler means for muffler of the gas output. The water exhaust line may have operatively associated therewith a water pump means for pumping water from the engine into the water heat exchanger means.

The apparatus may also contain a hydraulic oil line that has operatively associated therewith a hydraulic oil pump means for pumping hydraulic oil from the engine into the hydraulic oil heat exchanger and further associated therewith a hydraulic back pressure control means for controlling the back pressure of the engine.

In one embodiment, the chemical solution in the chemical supply reservoir contains the chemical selected from the group consisting of: hydrochloric or hydrogen fluoride acids. In another embodiment, the operator may select from the group consisting of diesel fuel oil, paraffin inhibitors, HCl and ethylenediaminetetraacetic acid (EDTA).

An advantage of the present invention includes it effectively removes paraffin, asphaltines and general scale deposits through the novel heating process. Another advantage is that fluids are heated in a single pass with continuous flow at temperatures of 180 degrees fahrenheit up to and exceeding 300 degrees fahrenheit without the aid of an open or enclosed flame. Yet another advantage is that the operator is no longer limited to use of heated water and chemicals for cleaning tubing and pipelines i.e. hydrocarbons can be used as the treating compound to be heated.

Another advantage is that hydrocarbons (such as diesel fuel) can be applied through the novel apparatus without the danger of exposure to open or enclosed flames. Yet another advantage is that with the use of heated hydrocarbons, the chemical consumption can be greatly reduced thus providing an economical method for paraffin and asphaltine clean outs. Of course, the novel system can still be used as means for heating chemicals and water for treatment of the tubing, pipeline, or alternatively, stimulating the reservoir.

A feature of the present invention is the system may be used with coiled tubing. Another feature is the engine used herein may be employed as a single power source for the coiled tubing and novel thermal fluid system. Still yet another feature is that the system is self-contained and is readily available for transportation to remote locations with minimal amount of space.

DETAILED DESCRIPTION OF THE PREFERRED EMBODIMENTS

Figure 1:
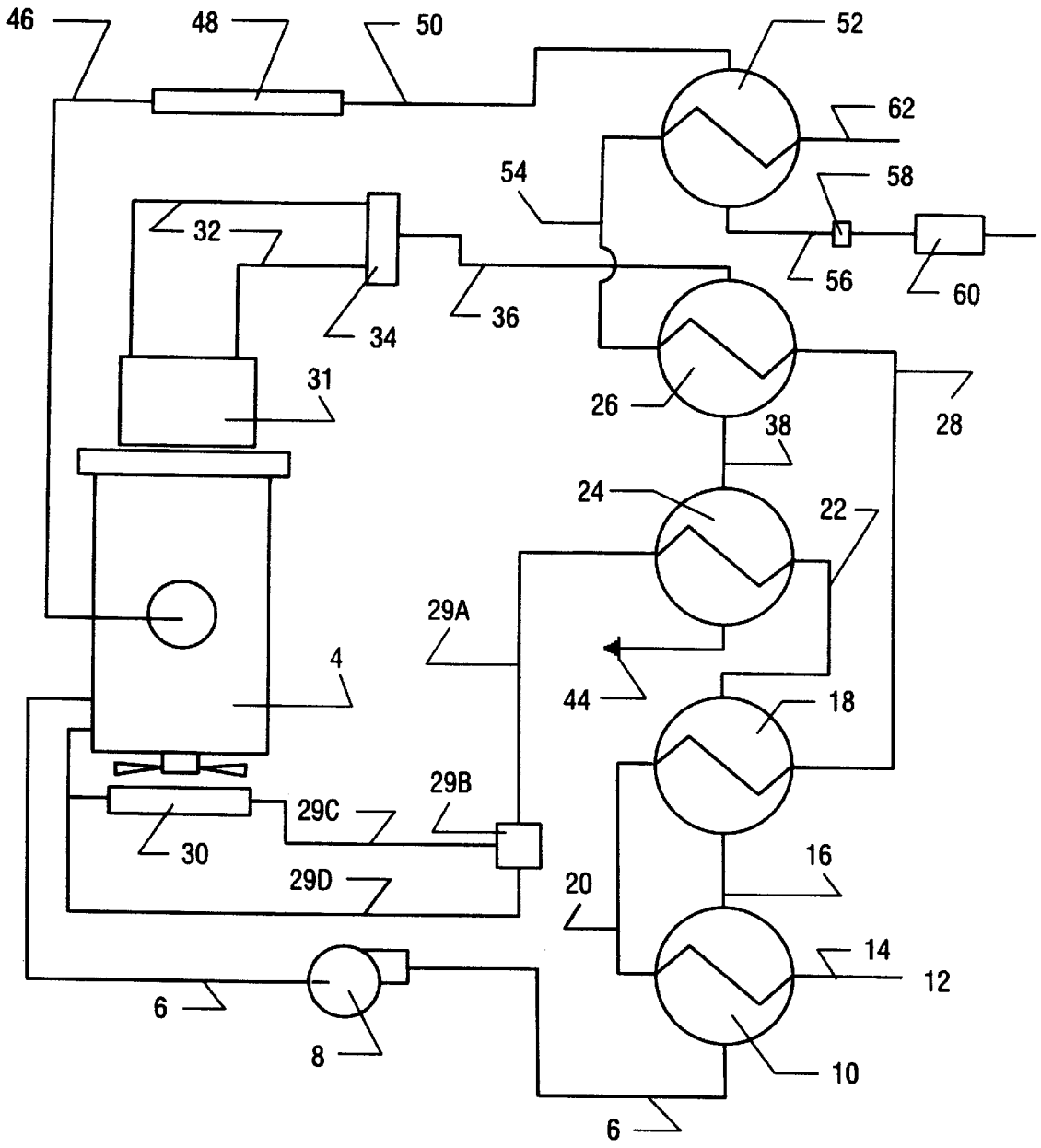
FIG. 1 is a schematic process diagram of the present invention.

Referring now to FIG. 1, a schematic process diagram of the present invention is illustrated. In the preferred embodiment, the novel thermal fluid system 2 includes a diesel engine 4 which is well known in the art. The engine 4 is used as the heat source since during its operation, the engine 4 will provide as an output a gas exhaust, a water exhaust, and a hydraulic oil exhaust. The type of diesel engine used in the preferred embodiment is commercially available.

The engine 4 will have associated therewith the water exhaust line 6 that leads to the water pump member 8. The water pump member 8 will then pump the exhaust water to the engine water jacket heat exchanger 10. As is well known in the art, the water heat exchanger 10 contains therein a tubular coil (not shown) that is wrapped within the water heat exchanger 10. A second coil (not shown) is disposed therein. The second coil is fluidly connected to a reservoir 12. The reservoir 12 will contain the treating compound such as acid, solvents or diesel oil which will be explained in greater detail later in the application. The list of treating compounds is illustrative.

The reservoir 12 will have a feed line 14 that will be connected to the engine water jacket heat exchanger. The feed line 14 will connect to the second coil. Thus, as the heated water is circulated within the heat exchanger 10, the treating compound is transferred the latent heat. In the preferred embodiment, a dual system of heat exchangers is provided as shown in FIG. 1. It should be understood that dual heat exchangers are depicted due to the increased capacity of heating the treating compound; nevertheless, only a single heat exchanger is possible.

As seen in FIG. 1, the heated water will exit the heat exchanger 10 via the feed line 16 and will enter the water jacket heat exchanger 18. The treating compound will exit the heat exchanger 10 via the feed line 20 into the heat exchanger 18, and the treating compound will again be transferred heat. The heated water will then exit the heat exchanger 18 via the feed line 22 and in turn enter the hydraulic heat exchanger 24. The treating compound will exit the heat exchanger 18 and will be steered into the hydraulic heat exchanger 26 via the feed line 28. The treating compound is directed to the hydraulic heat exchanger 26 and not the hydraulic heat exchanger 24.

The water will then be directed to the exit feed line 29A which has associated therewith a thermostatic valve 29B that controls the opening and closing of valve 29B based on water temperature within line 29A. From the thermostatic valve 29B, two branches exit, namely line 29C and 29D. Thus, if the temperature is low enough, the valve 29B directs the water to the engine 4 (thereby bypassing the radiator 30). Alternatively, if the water temperature is still elevated, the valve 29B will direct the water to the radiatior 30 for cooling, and thereafter, to the engine 4.

The engine 4 will have operatively associated therewith the hydraulic pump member 31 as is well understood by those of ordinary skill in the art. The hydraulic pump member 31 will direct the hydraulic oil to the feed line 32 that in turn leads to a hydraulic back pressure pump 34 that will be used for controlling the back pressure. From the hydraulic back pressure pump 34, the feed line 36 leads to the hydraulic heat exchanger 26. The hydraulic oil feed into the hydraulic heat exchanger 26 will exit into the hydraulic heat exchanger 24 via the feed line 38. Thus, the heat exchanger 24 has two heated liquids being circulated therein, namely: water and hydraulic oil. The hydraulic oil will exit the heat exchanger 24 via the feed line 42 and empty into the hydraulic oil tank 44.

The engine, during operation, will also produce an exhaust gas that is derived from the combustion of the hydrocarbon fuel (carbon dioxide). Thus, the engine has attached thereto an exhaust gas line 46 that in the preferred embodiment leads to the catalytic converter member 48. From the catalytic converter 48, the feed line 50 directs the gas to the exhaust heat exchanger 52 which is similar to the other described heat exchangers, namely 10, 18, 24, 26. Thus, the gas will be conducted therethrough.

As depicted in FIG. 1, the treating compound will exit the hydraulic heat exchanger 26 via the feed line 54 and thereafter enter the exhaust heat exchanger 52 for transferring the latent heat of the gas exhaust to the treating compound. In the preferred embodiment, the gas will exit via the feed line 56 with the feed line 56 having contained therein the adjustable back pressure orifice control member 58 for controlling the discharge pressure of the gas into the atmosphere. The back pressure orifice control member 58 is commercially available.

Thereafter, the feed line 56 directs the gas into the muffler and spark arrester 60 for suppressing the noise and any sparks that may be generated from ignition of unspent fuel. The gas may thereafter be discharged into the atmosphere. The outlet line 62 leads from the exhaust heat exchanger 52.

In accordance with the teachings of the present invention, the treating compound thus exiting is of sufficient temperature to adequately treat the well bore in the desired manner.

During the well's life, when a well produces formation water, gyp deposits may accumulate on the formation face and on downhole equipment and thereby reduce production. These deposits may also form on the internal diameter of the tubing. The deposits may have low solubility and be difficult to remove. Solutions of HCl and EDTA can often be used to remove such scales. Soluble portions of the scale are dissolved by the HCl while the chelating action of EDTA breaks up and dissolves much of the remaining scale portions. When deposits contain hydrocarbons mixed with acid-soluble scales, a solvent-in-acid blend of aromatic solvents dispersed in HCl can be used to clean the wellbore, downhole equipment, and the first few inches of formation around the wellbore (critical area) through which all fluids must pass to enter the wellbore. These blends are designed as a single stage that provides the benefits of both an organic solvent and an acid solvent that contact the deposits continuously.

With reference to paraffin removal, several good commercial paraffin solvents are on the market. These materials can be circulated past the affected parts of the wellbore or simply dumped into the borehole and allowed to soak opposite the trouble area for a period of time. Soaking, however, is much less effective because the solvent becomes saturated at the point of contact and stagnates.

Hot-oil treatments also are commonly used to remove paraffin. In such a treatment, heated oil is pumped down the tubing and into the formation. The hot oil is pumped down the tubing and into the formation. The hot oil dissolves the paraffin deposits and carries them out of the well bore when the well is produced. When this technique is used, hot-oil treatments are usually performed on a regularly scheduled basis.

Paraffin inhibitors may also be used. These are designed to create a hydrophilic surface on the metal well equipment. This in turn minimizes the adherence of paraffin accumulations to the treated surfaces.

Acid treatments to stimulate and/or treat skin damage to the producing formation is also possible with the teachings of the present invention. Thus, the operator would select the correct type of acid, for instance HCl or HF, and thereafter inject the heated compound into the wellbore, and in particular, to the near formation face area, in accordance with the teachings of the present invention.

Figure 2:
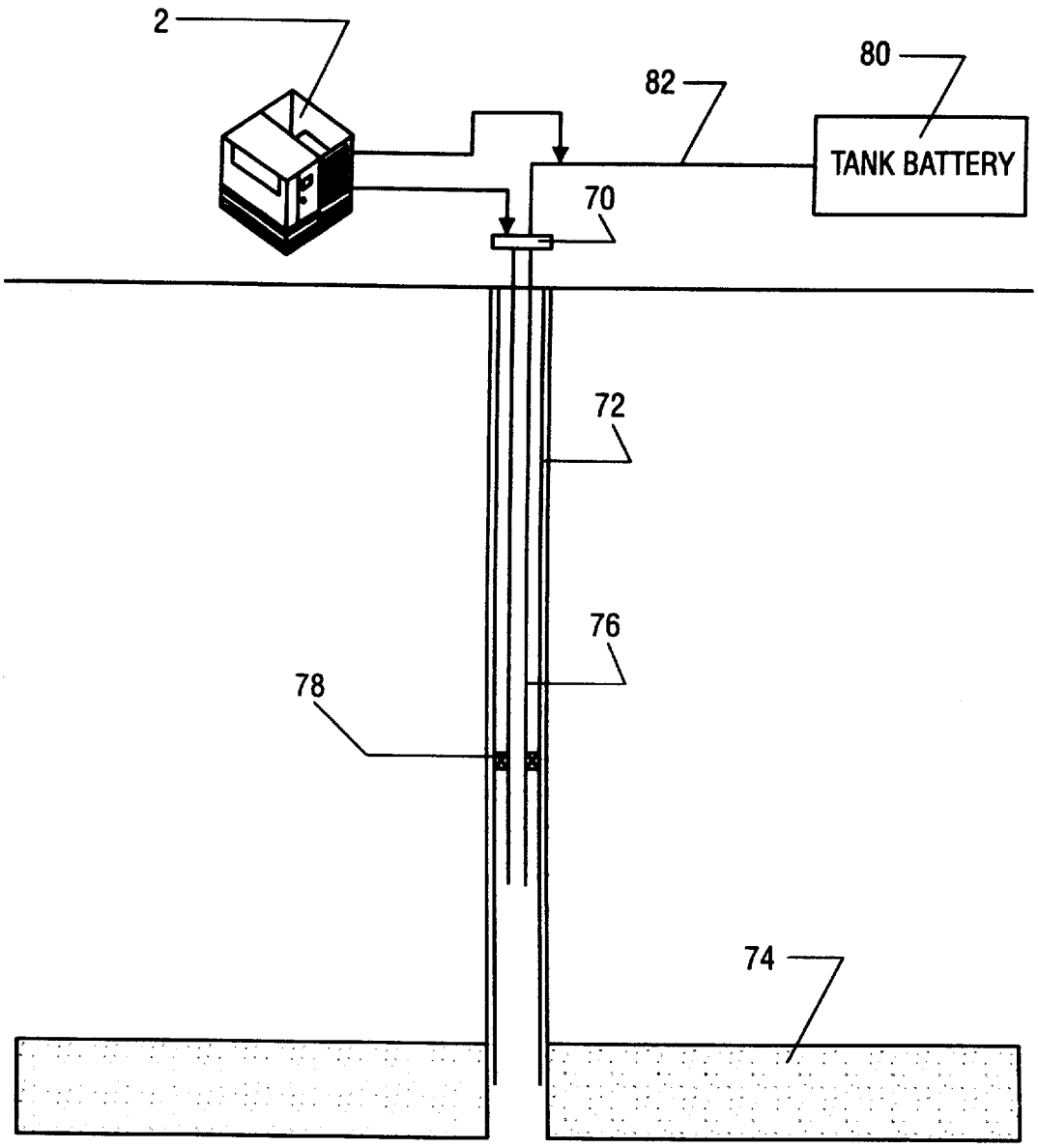
FIG. 2 is a schematic view of one embodiment of the present invention situated on a land location.

The heating of the treating compound will enhance the effectiveness of the treatment. In FIG. 2, a schematic view of one embodiment of the present invention situated on a land location is illustrated. The novel thermal fluid system 2 is shown in a compact, modular form. The system 2 is situated adjacent a well head 70, with the well head containing a series of valves. The well head 70 will be associated with a wellbore 72 that intersects a hydrocarbon reservoir 74.

The wellbore 72 will have disposed therein a tubing string 76 with a packer 78 associated therewith. The production of the hydrocarbons from the reservoir 74 proceeds through the tubing string 76, through the well head 70 and into the production facilities 80 via the pipeline 82.

Thus, in operation of the present invention, if the well bore 72, and in particular, the tubing string 76 becomes coated with scale deposits such as calcium carbonate and/or barium sulfate, the appropriate treating compound may be heated in the novel thermal fluid system 2 as previously described. Thereafter, the heated treating compound may be pumped into the tubing string so as to react with the scale deposit on the internal diameter of the tubing string 76. Generally, the same method is employed for parrafin removal.

If the operator deems it necessary to stimulate the reservoir 74 in accordance with the teachings of the present invention, the operator may heat the treating compound in the system 2 as previously described, and thereafter, inject the heated treating compound down the internal diameter of the tubing string 76 and ultimately into the pores of the reservoir so as to react with any fines, clay, slit, and other material that destroys the permeability and/or porosity of the reservoir 74. Still yet another procedure would be to heat a treating compound in the system 2, as previously described, and thereafter inject into the pipeline 82.

Figure 3:
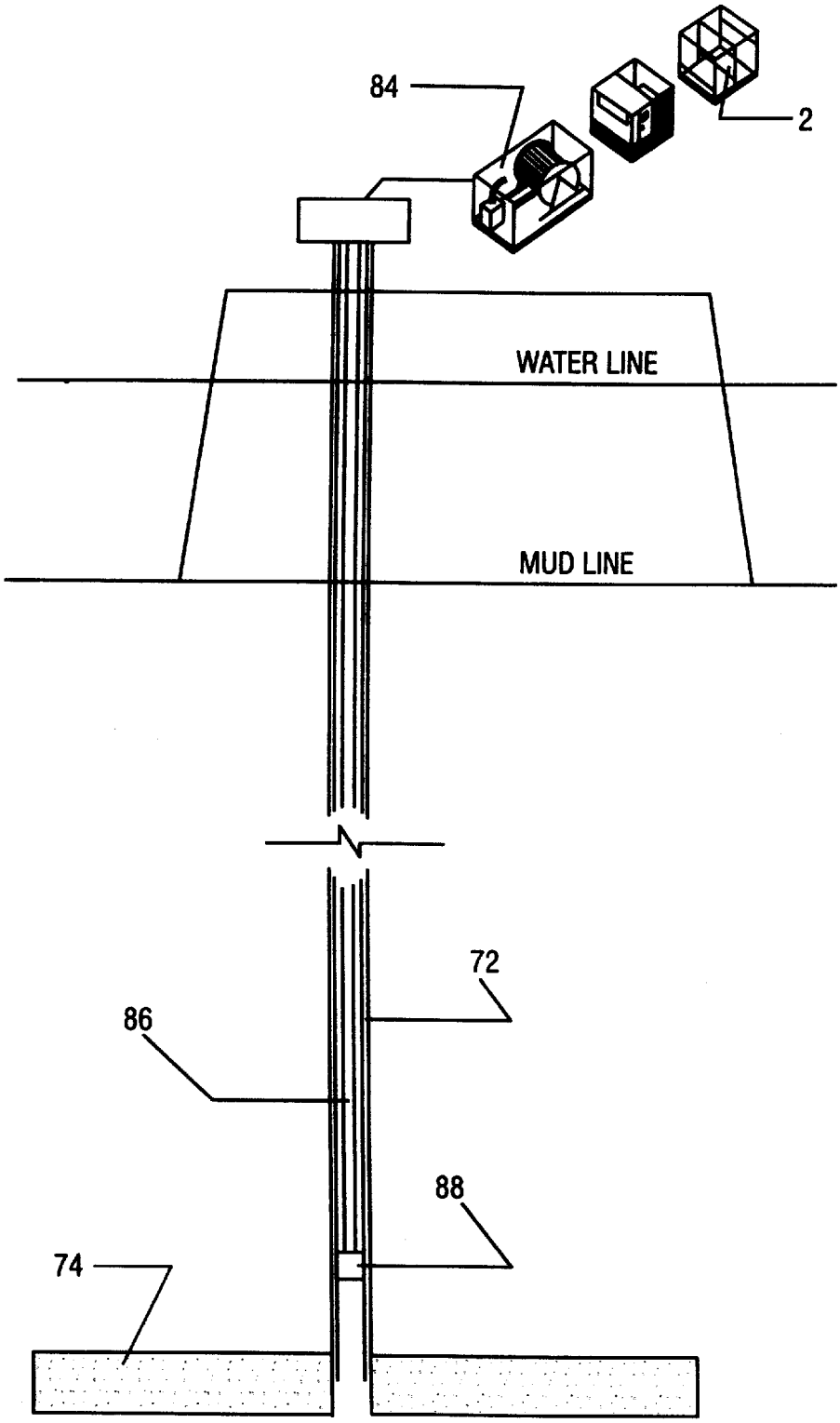
FIG. 3 is a schematic view of a second embodiment of the present invention utilizing a coiled tubing unit.

Referring now to FIG. 3, schematic view of a second embodiment of the present invention utilizing a coiled tubing unit 84. This particular embodiment depicts an offshore platform with the coiled tubing unit 84 and novel thermal fluid system 2 thereon. Moreover, the coiled tubing unit 84 and the thermal system 2 may utilize the same power source, which is the engine 4 of the system 2. It should be noted that like numbers appearing in the various figures refer to like components.

The treating compound, which may be a paraffin remover, a scale remover, or acid compound for reservoir stimulation, will be heated in the system 2. Thereafter, the heated treating compound will be injected into the reeled tubing unit 84 and in particular the tubing 86. The tubing 86 may be lowered to a specified depth and the pumping may begin. The tubing 86 will have associated therewith an injector head 88. Alternatively, the pumping may begin, and the injector head 88 may be raised and lowered in order to continuously pump the treating compound over a selective interval.

Changes and modifications in the specifically described embodiments can be carried out without departing from the scope of the invention which is intended to be limited only by the scope of the appended claims.

I claim:

1. A method of treating a well bore, the method comprising:

producing a water exhaust from an engine;

channeling the water exhaust to a heat exchanger;

injecting a chemical solution into the heat exchanger, wherein the chemical solution comprises an acid; and injecting the heated chemical solution into a well bore.

2. The method as set forth in claim 1, wherein the solution is heated to greater than about 180° Fahrenheit before injection into the well bore.

3. The method as set forth in claim 1 wherein the chemical solution comprises an aqueous solution of hydrofluoric acid, hydrochloric acid, or a mixture thereof.

4. The method as set forth in claim 1, wherein the chemical solution comprises diesel oil, a solvent-in-acid blend, a paraffin solvent, or EDTA.

5. The method as set forth in claim 1 further comprising the step of operatively connecting said engine to a hydraulic pump, wherein the hydraulic pump pumps a hydraulic oil, and further comprising a hydraulic backpressure pump, wherein the back pressure on said pump may be operatively controlled.

6. The method as set forth in claim 1 wherein the chemical solution comprises a solvent-in-acid blend.

7. The method as set forth in claim 1, wherein the chemical solution comprises an aromatic solvent.

8. The method of claim of claim 1, wherein the chemical solution comprises hydrochloric acid.

9. The method of claim of claim 1, wherein the chemical solution comprises hydrofluoric acid.

10. A method of treating a well bore, the method comprising:

producing two exhausts selected from a group consisting of a water exhaust, a gas exhaust, and a hydraulic oil exhaust, the exhausts being produced by an engine;

channeling the first of the two exhausts to a first heat exchanger and channeling the second of the two exhausts to a second heat exchanger;

injecting a chemical solution into said first heat exchanger and said second heat exchanger, wherein the chemical solution comprises an acid; and injecting said heated chemical solution into a well bore.

11. The method as set forth in claim 10, wherein the chemical solution is injected serially into the first and second heat exchangers.

12. The method as set forth in claim 10, wherein the solution is heated to greater than about 180° Fahrenheit before injection into the well bore.

13. The method as set forth in claim 10, wherein the chemical solution comprises an aqueous solution of hydrofluoric acid or hydrochloric acid.

14. The method as set forth in claim 10, wherein the chemical solution comprises diesel oil, solvent-in-acid blend, paraffin solvent, or EDTA.

15. The method as set forth in claim 10, further comprising treating a hydrocarbon reservoir with the heated chemical solution.

16. The method as set forth in claim 10, wherein the first of the two exhausts is a water exhaust and the second of the two exhausts is a hydraulic oil exhaust.

17. A method of treating a well bore, comprising:

producing a water exhaust, a gas exhaust, and a hydraulic oil exhaust from an engine;

channeling the water exhaust to a first heat exchanger, channeling the gas exhaust to a second heat exchanger, and channeling the hydraulic oil exhaust to a third heat exchanger;

injecting a chemical solution into said first, second, and third heat exchangers to heat the chemical solution; and injecting said heated chemical solution into a well bore.

18. The method as set forth in claim 17, wherein the solution is heated to greater than about 180° Fahrenheit before injection into the well bore.

19. The method as set forth in claim 17, wherein the chemical solution is injected serially into the first, second, and third heat exchangers.

20. The method as set forth in claim 17, further comprising treating a hydrocarbon reservoir with the chemical solution.

21. An apparatus for heating a chemical solution to treat a well bore, comprising:

an engine having first and second exhaust lines selected from the group consisting of a water exhaust line, a hydraulic oil exhaust line, and gas exhaust line;

a first and a second heat exchanger in fluid communication with said first and second exhaust lines;

a chemical solution supply reservoir;

a first feed line in fluid communication with the supply reservoir and the first heat exchanger;

a second feed lines in fluid communication with the supply reservoir and the second heat exchanger; and a coiled tubing unit operatively associated with said engine.

22. The apparatus as set forth in claim 21, wherein the first feed line connects the reservoir to the first heat exchanger and the second feed line connects the output of the first heat exchanger to the second heat exchanger.

23. The apparatus as set forth in claim 21, wherein the first feed line connects the reservoir to the first heat exchanger and the second feed line connects the reservoir to the second heat exchanger.

24. The apparatus as set forth in claim 21, wherein the reservoir is capable of reserving aqueous solutions of hydrochloric acid or hydrofluoric acid.

25. The apparatus as set forth in claim 21, where the first exhaust is a hydraulic oil exhaust, and further comprising a hydraulic backpressure pump disposed in the hydraulic oil exhaust line, where the back pressure on said pump may be operatively controlled, the hydraulic exhaust being adapted to control the back pressure of the engine.

26. The apparatus as set forth in claim 21, wherein first and second exhausts are a water exhaust and a hydraulic oil exhaust, respectively.

27. An apparatus for heating a chemical solution to treat a well bore, comprising:

an engine having a water exhaust line, a hydraulic oil exhaust line, and a gas exhaust line;

a first, a second, and a third heat exchanger in fluid communication with the water, the hydraulic oil, and the gas exhaust lines;

a chemical solution supply reservoir;

a first feed line in fluid communication with the supply reservoir and the first heat exchanger;

a second feed line in fluid communication with the supply reservoir and the second heat exchanger;

a third feed line in fluid communication with the supply reservoir and the third heat exchanger, the three heat exchangers being connected in series; and a coiled tubing unit operatively associated with said engine.

* * * * *